US006279180B1

(12) United States Patent
Bell et al.

(10) Patent No.: US 6,279,180 B1
(45) Date of Patent: Aug. 28, 2001

(54) ADHESIVE BACKED PHOTOLUMINESCENT PANELS FOR COMMODE AND METHOD OF USE

(76) Inventors: Jonathan Marc Bell, 1600 Hopegate Dr., Maple Glen, PA (US) 19002; Jonathan Todd Pollack, 1406 Southwind Way, Dresher, PA (US) 19025

( * ) Notice: Subject to any disclaimer, the term of this patent is extended or adjusted under 35 U.S.C. 154(b) by 0 days.

(21) Appl. No.: 09/677,813

(22) Filed: Oct. 3, 2000

Related U.S. Application Data

(60) Provisional application No. 60/157,122, filed on Oct. 4, 1999.

(51) Int. Cl.[7] ..... A47K 13/00; E03D 1/00

(52) U.S. Cl. ..... 4/661; 4/234; 4/237; 4/242.1; 4/DIG. 9; 362/84

(58) Field of Search ..... 4/661, 234, 237, 4/242.1, DIG. 9; 362/84

(56) References Cited

U.S. PATENT DOCUMENTS

| | | | |
|---|---|---|---|
| 5,003,648 | 4/1991 | Anderson | 4/661 |
| 5,123,130 | 6/1992 | Sanders | 4/661 |
| 5,136,476 | 8/1992 | Horn | 362/198 |
| 5,263,209 | 11/1993 | Pattee | 4/661 |
| 5,276,595 | 1/1994 | Patrie | 362/101 |
| 5,307,524 | 5/1994 | Veal | 4/246.1 |
| 5,664,867 | 9/1997 | Martin et al. | 362/101 |
| 5,689,842 | 11/1997 | Delaney et al. | 4/661 |
| 6,166,496 * | 12/2000 | Lys et al. | 315/316 |

* cited by examiner

*Primary Examiner*—David J. Walczak
*Assistant Examiner*—Kathleen J. Prunner
(74) *Attorney, Agent, or Firm*—Caesar, Rivise, Bernstein, Cohen & Pokotilow, Ltd.

(57) ABSTRACT

The combination of plural photoluminescent panels and a commode and a method of illuminating the commode are described. The commode has a bowl including a top surface and an arcuate inner wall portion contiguous with the top surface. The commode may also include a seat pivotally connected to the bowl for selective disposition on the top surface of the bowl, and a cover pivotally connected to the bowl for selective disposition on the seat. Each photoluminescent panel is a generally planar, flexible member of generally rectangular shape having rounded corners. Each panel has an exterior surface and an interior surface, with its exterior surface being arranged to be activated by exposure to ambient light to produce photoluminescent illumination when the ambient light decreases to a threshold level. The interior surface of each panel includes an adhesive, e.g., a pressure sensitive adhesive, thereon covered by a peel-off liner. The adhesive of each panel is arranged to be exposed by removal of the liner so that the panel may be adhesively secured by the adhesive to the arcuate inner wall, e.g., the rear portion of the commode. Once mounted the top surface of each panel is oriented in a generally vertical orientation for receipt of the ambient light, so that each panel illuminates at least a portion of the commode when the ambient light decreases to the threshold level. Another photoluminescent panel may be adhesively secured to the seat. Still another photoluminescent panel may be adhesively secured to the cover.

7 Claims, 1 Drawing Sheet

ADHESIVE BACKED PHOTOLUMINESCENT PANELS FOR COMMODE AND METHOD OF USE

RELATED APPLICATION

This application is an Application based on a Provisional Application Ser. No. 60/157,122 filed Oct. 4, 1999 entitled ADHESIVE BACKED PHOTOLUMINESCENT STRIPS FOR COMMODE, whose entire disclosure is incorporated by reference herein.

BACKGROUND OF THE INVENTION

This invention relates generally to commodes, and in particular to devices for adhesive application to a commode to enable users to see at least a portion of the commode in the dark.

Usage of a toilet or commode by males for urination typically entails lifting the toilet seat to its raised position to expose the bowl, whereas use by females typically entails leaving the seat in place or down on the bowl rim. It is widely accepted that as a rule males tend to leave the toilet seat in the raised position after use, thus rendering the toilet unsuitable for use by a subsequent female user unless she lowers the seat. This tendency has engendered some animosity by females to males sharing the same toilet facilities who leave the toilet seat up after dark. The patent literature includes various patents directed to illumination systems for illuminating a toilet or commode. For example, U.S. Pat. No. 5,689,842 (Delaney et al.) discloses a phosphorescent illuminating member that clips onto the inside rim of a toilet bowl to enable users to help find the toilet in the dark. The phosphorescent member comprises a substantially flat rim portion having a substantially arcuate shape adapted for resting on the upper surface of a toilet bowl rim. The rim portion has an inside edge for orienting toward the interior of the toilet bowl and an outside edge for orienting away from the interior of the toilet bowl. The rim portion also has first and second ends for positioning on the upper surface of the toilet bowl rim. A clip in the form of a pair of discrete inner flanges are provided connected to the inner edge of the rim portion at one of the first and second ends, and a continuous outer flange extending along the entire outer edge of the rim portion, thereby permitting the flanges to embrace a portion of the toilet bowl rim.

U.S. Pat. No. 5,664,867 (Martin et al.) discloses a battery-operated, night light for a toilet seat that is responsive to the position of the toilet seat, e.g., the light turns on when the seat is lifted.

U.S. Pat. No. 5,263,209 (Pattee) discloses a night light for a toilet. The night light is a flexible, moisture impermeable, transparent tube is positioned under an upper rim of the toilet bowl and extends therearound. A plurality of spaced apart electrical lamps lay within the tube and are wired with a switch and a power source for receiving electrical power. Double-sided adhesive tape is included for mounting the power source on the external surface of the toilet. A plurality of holding clips are positioned in spaced relationship around the toilet rim for removably holding the tube in position under the upper rim of the toilet. The switch is position sensitive and may be fixed to the toilet seat, the seat being capable of assuming a horizontal or a vertical orientation. A first latching switch and a second latching switch are included, each of which may energize the lamps by either lifting the toilet seat into a vertical position or by lowering the hinged member into a horizontal position, respectively. A delay circuit de-energizes the lamps by breaking the circuit after a pre-set delay time.

U.S. Pat. No. 5,307,524 discloses an automatic toilet seat device which will cause a toilet seat to be either raised or lowered at the push of a single button and further, will automatically lower the toilet seat after the flush action of the toilet. The toilet lid includes an illumination source, e.g., an elongated tubular light held in position within an outer covering material of the toilet lid.

U.S. Pat. No. 5,276,595 (Patrie) discloses a toilet light assembly for use at nighttime. The assembly includes a toilet seat position sensor, a color-coded light comprised of two light sources each of a different color, a chime generator, a person sensor and a darkness sensor. When a person in darkness is sensed in the vicinity of the toilet, the assembly energizes the color-coded light in response to the toilet seat position sensor. If the seat is up, the toilet area is illuminated with red lighting and a brief chime is sounded. If the seat is down, the toilet area is quietly illuminated with green lighting. Thus the invention provides a colorful and unambiguous indicator of the position of the seat and provides a comfortable level of lighting to automatically facilitate nighttime use of the toilet.

U.S. Pat. No. 5,136,476 (Horn) discloses a portable illuminator for the illuminating of toilet bowls. The illuminator hangs on the rim of a toilet bowl by a tubular conduit through which electrical conductors carry current from a battery pack or other power source external to the bowl and to a light source suspended within the bowl.

U.S. Pat. No. 5,123,130 (Sanders) discloses a system including a flexible luminescent ring to help provide directional training for children in the use of a commode in low light conditions. The system includes an interior annular surface and an exterior annular surface coaxial with the interior surface. An adhesive strip is mounted coextensively to the interior annular surface of the ring to permit securement of the ring on the top surface of the rim of the commode.

U.S. Pat. No. 5,003,648 (Anderson) discloses a light device for lighting the bowl of a toilet. The device includes a horseshoe shaped web to lie on top of the rim of the toilet. Flanges extend from the web outside of the bowl to hold the web in position. Flanges extend inside the bowl and carry lights. The flanges shield the lights for protection of the lights, and to provide indirect lighting for the bowl. A housing at the rear of the toilet carries a switch for engagement by the lid of the toilet, so the light is turned on when the lid is up. The housing also receives batteries for powering the lights.

While the aforementioned patents are generally suitable for their intended purposes, they never the less leave something to be desired from one or more of the following standpoints, simplicity of construction, low cost, need for electrical (e.g., battery) power, need to replace worn components (e.g., electrical bulbs), size, aesthetics, conspicuousness, ease of use, effectiveness, long term usage, etc.

SUMMARY OF THE INVENTION

In accordance with one aspect of this invention there is provided in combination at least one photoluminescent panel and a commode and a method for illuminating the commode by use of the at least one photoluminescent panel. The commode has a bowl including a top surface and an arcuate inner wall portion contiguous with the top surface. In addition the commode may include a seat pivotally connected to the bowl for selective disposition on the top surface of the bowl and a cover pivotally connected to the bowl for selective disposition on the seat. The photoluminescent panel comprises a generally planar, flexible strip having an exterior surface and an interior surface. The exterior surface of the panel is constructed to produce photoluminescent illumination in the dark after exposure to ambient light.

The interior surface of the photoluminescent panel has an adhesive, e.g., a pressure sensitive adhesive, thereon that is initially covered by a peel-off liner. The adhesive is arranged to be exposed by removal of the liner, whereupon the panel may be adhesively secured by it to the arcuate inner wall portion of the commode to effect the illumination of a contiguous portion of the commode after illumination by the ambient light.

DETAILED DESCRIPTION OF THE PREFERRED EMBODIMENT

Figure 1:
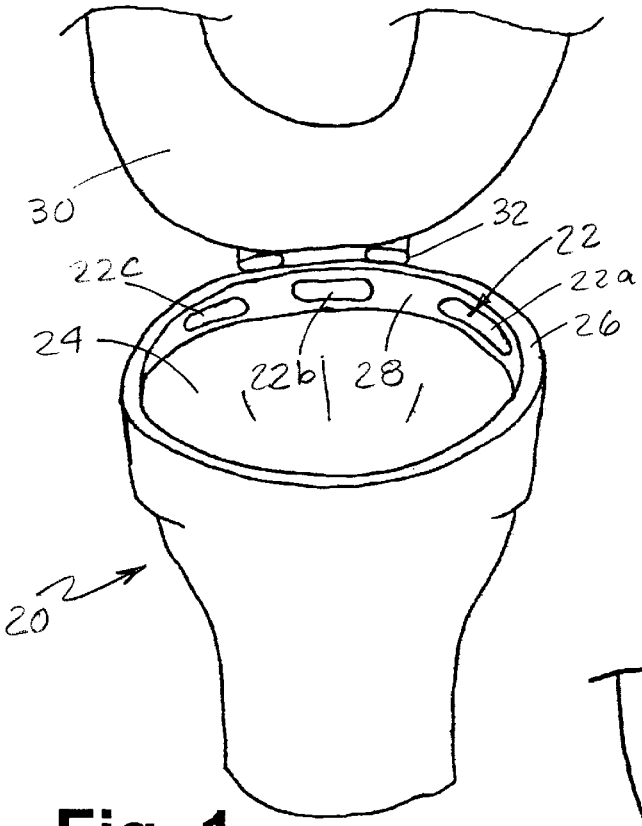
FIG. 1 is an isometric view of one exemplary commode having plural photoluminescent panels adhesively secured to the bowl of the commode to illuminate contiguous portions of the bowl after activation by ambient light.

Referring now to the various figures of the drawing wherein like reference characters refer to like parts, there is shown at 20 in FIG. 1 a conventional toilet or commode which has been modified in accordance with this invention to include at least one photoluminescent panel 22 on the inner rim of the commode's bowl.

Figure 2:
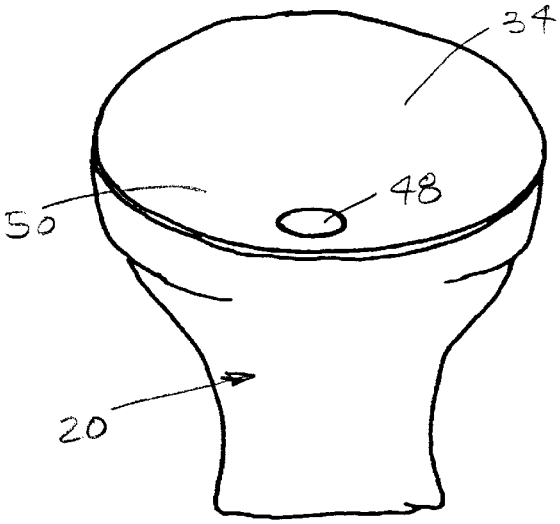
FIG. 2 is an isometric view of the commode shown in FIG. 1 having at least another, and optional, photoluminescent panel adhesively secured to the cover or lid of the commode to illuminate contiguous portions of the cover or lid after activation by ambient light.
Figure 3:
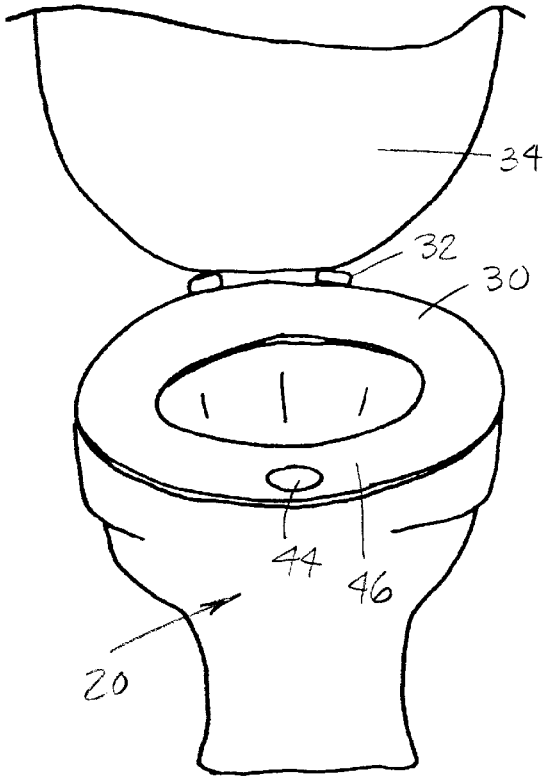
FIG. 3 is an isometric view of the commode shown in FIG. 1 having at least another, and optional, photoluminescent panel adhesively secured to the seat of the commode to illuminate contiguous portions of the seat after activation by ambient light.

The commode 20, being of conventional construction, includes a bowl 24 having an upper rim in the form of a planar top surface 26, and an arcuate vertically oriented inner wall surface 28 contiguous with the top surface 26. The arcuate inner wall surface 28 may be round or oval, depending upon the shape of the bowl. A conventional seat 30 is pivotally mounted on the bowl by a hinge 32 and is arranged to be pivoted from a lowered or down position (shown in FIG. 3) wherein it rests on the top surface 26 of the bowl 24 to an up or raised position fully exposing the bowl 24 (as shown in FIG. 1). It is in the up or raised position that most males use when urinating into the bowl. The seat 30 can also be pivoted to the lowered or down position for use by women. A conventional lid or cover 34 is also provided on the commode, although this component is optional, since numerous commodes do not make use of a cover or lid. Like the seat 30 the cover 34 is pivotally connected to the bowl by the hinge 32, and can be pivoted to a down orientation or position wherein it rests on top of the seat as the seat rests on the top surface of the bowl (as shown in FIG. 2), or can be in the raised position (as shown in FIGS. 1 and 3).

Each of the photoluminescent panel(s) of this invention basically comprise a flexible sheet or strip of a conventional photoluminescent material, such as that sold under the trademark Glo-Brite (#7530) by Jessup Manufacturing Company of McHenry, Ill. 60051. Other similar conventional photoluminescent sheets or strips can be used as well.

In accordance with a preferred embodiment, three photoluminescent panels 22*a*, 22*b* and 22*c* are fixedly mounted on the inner wall 28 of the bowl 24 adjacent the top wall 26 and toward the rear of the bowl, i.e., adjacent the hinge 32. Each panel is a generally rectangular shaped or strip-like member having rounded corners, with the size of each ranging anywhere from 0.5" to 2" high and 0.5" to 5" long. The radius of the rounded corners may be anywhere from 0.5"–1", depending upon the length of the panel.

Figure 4:
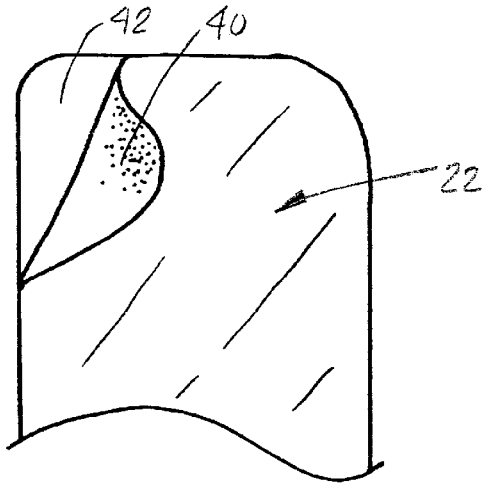
FIG. 4 is an enlarged isometric view of a portion of one of the photoluminescent panels shown in FIG. 1.

In order to affix the panels 22*a*, 22*b* and 22*c* to the bowl, each panel includes an inner surface 40 (FIG. 4) having a pressure sensitive adhesive thereon. A peel-off cover sheet or liner 42 of the same general shape as the panel is temporarily located on the adhesive surface to protect it until it is ready for use to mount the panel to the commode bowl. At that time the cover sheet 42 is peeled off the panel to expose the adhesive surface 40. The panel, with the now exposed adhesive is then pressed into position to affix it at the desired location on the wall 28 of the bowl 24.

The outer surface of each panel 22*a*–22*c* is formed of the photoluminescent material(s). As is known, such materials when activated by ambient light of a sufficient strength and duration, will emit light (luminesce) after the ambient light drops below a predetermined threshold value, e.g., in the dark. In the exemplary embodiment of the panels described above, i.e., the Glo-Brite (#7530) strips, exposure to ambient room light of at least 15 minutes will enable the strip to glow for approximately ten hours after the ambient light drops below the threshold, e.g., the room is dark, such as occurs in the evening.

It should be pointed out at this juncture that in lieu of using three panels 22*a*, 22*b* and 22*c*, only one or two photoluminescent panels can be used secured to the inner vertical wall of the bowl adjacent the top surface. The use of three panels, like shown herein, enables good conformance with the arcuate shape of the bowl and for reasons to be discussed later.

If desired a photoluminescent panel 44 of the same type of material as the panels 22*a*, 22*b* and 22*c* may be applied on the top surface 46 of the seat 30 adjacent the front thereof, such as shown in FIG. 3. The panel 44, may be of any conventional shape. In the embodiment shown it comprises a circle. Another panel 48 of the same type of material as the panel 44 may be applied on the top surface 50 of the cover or lid 34 adjacent the front thereof, such as shown in FIG. 2.

As will be appreciated using at least one panel 22*a*–22*c* on the inner wall of the commode bowl should help a male (from the standing position) use the toilet accurately in the middle of the night without putting the light on. The subject invention also helps a person of either sex to locate the toilet itself as they walk into the bathroom in the dark. This should help to avoid bumping into or tripping over the toilet. Further still, the subject invention can also help a person of either sex to determine whether or not the toilet seat 30 is up or down. For women, this is important so as not to accidentally sit "into" the toilet bowl, while for men it is important that the seat be up so that the seat does not get soiled with any urine that may splatter during urination. Further still, if the optional photoluminescent panel is used on either the seat or the lid or both, as described above, it can indicate whether the cover is up or down. For men, this is of considerable importance so as not to attempt to use a toilet that is not actually open, i.e., a toilet whose lid or cover 34 is down.

Since each photoluminescent panel is designed to charge with normal ambient light, the subject invention overcomes the deficiencies of other prior art devices which require an electrical current to provide the illumination. Moreover, the photoluminescent charging ability eliminates the possibility of electric shock, battery corrosion, battery replacement and bulb replacement, as well as the need for an electric current. The photoluminescent panels are designed to charge quickly, e.g., 15 minutes of normal light will fully charge the panel.

Other advantages of the panels are that each is self-adhering. This eliminates the need for any additional clips and or glue and keeps the application process simple and neat. In short each panel is extremely easy to apply, e.g., "peel and stick." Moreover, each panel is inexpensive.

As mentioned earlier, the corners of each panel are preferably rounded, since right angled corners have a tendency to peel up very easily due to the lack of substantial surface area toward the point of the corner, particularly, in an environment where liquids are present. This feature is also of importance from the standpoint of cleanliness, since if the panel had corners which could come up they could become dirty and unsanitary. The rounded corners of the subject panels overcome this problem.

As also mentioned earlier the length of the panels may vary from 0.5" to as much as 5". The panels 22*a* and 22*c* may be slightly shorter strips (e.g., no more than 3" in length) than the center panel 22*b* to accommodate the oblong portion of certain toilets. Because most toilets are not circular, it is not possible to run a vertical strip cleanly around the inner rim of the bowl keeping the strip parallel to the top 26 of the rim. Thus, the strip will tend to "buckle" or "crease" in certain spots if kept parallel to the top of the rim. By shortening some of the panel strips, it is possible to apply them in oblong areas of the bowl without creases or buckling.

Moreover, each panel is very thin and flexible to enable it to be nearly undetectable in normal light in the interest of aesthetics. Further still, by being very thin and closely conforming to the inner surface of the bowl the panels are unobtrusive, they do not block access to the bowl, and are easy to clean.

Without further elaboration the foregoing will so fully illustrate our invention that others may, by applying current or future knowledge, adopt the same for use under various conditions of service.

We claim:

1. The combination of at least one photoluminescent panel and a commode, said commode having a bowl including a top surface and an arcuate inner wall portion contiguous with said top surface, said photoluminescent panel comprising a generally planar, flexible member having an exterior surface and an interior surface, said exterior surface being arranged to be activated by exposure to ambient light to produce photoluminescent illumination when the ambient light decreases to a threshold level, said interior surface of said panel having an adhesive thereon covered by a peel-off liner, said adhesive of said panel being arranged to be exposed by removal of said liner, whereupon said panel may be adhesively secured by said adhesive to said arcuate inner wall portion of said commode, whereupon said exterior surface of said panel is oriented in a generally vertical orientation for receipt of the ambient light, so that said panel illuminates at least a portion of said commode when the ambient light decreases to the threshold level.

2. The combination of claim 1 wherein said at least one photoluminescent panel is of generally rectangular shape having rounded corners.

3. The combination of claim 1 wherein said commode additionally comprises a seat pivotally connected to said bowl and arranged to be selectively disposed on said top surface of said bowl, and wherein said combination additionally comprises at least a second photoluminescent panel for adhesive securement on said seat.

4. The combination of claim 1 wherein said commode additionally comprises a cover pivotally connected to said bowl and a seat pivotally connected to said bowl, said seat being arranged to be selectively disposed on said top surface of said bowl, said cover being arranged to be selectively disposed on said seat when said seat is disposed on said top surface of said bowl, and wherein said combination additionally comprises at least a second photoluminescent panel for adhesive securement on said cover.

5. A method of illuminating at least a portion of a commode, the commode having a bowl including a top surface and an arcuate inner wall portion contiguous with the top surface, said method comprising:

(A) providing a photoluminescent panel comprising a generally planar, flexible member having an exterior surface and an interior surface, said exterior surface being arranged to be activated by exposure to ambient light to produce photoluminescent illumination when the ambient light decreases to a threshold level, said interior surface of said panel having an adhesive thereon covered by a peel-off liner;

(B) peeling off said line to expose said adhesive of said panel; and (C) adhesively securing said panel by said exposed adhesive to said arcuate inner wall portion of said commode so that said exterior surface of said panel is oriented in a generally vertical orientation for receipt of the ambient light, whereupon said panel illuminates at least a portion of said commode when the ambient light decreases to the threshold level.

6. The method of claim 5 wherein said commode additionally comprises a seat pivotally connected to said bowl and arranged to be selectively disposed on said top surface of said bowl, and wherein said method additionally comprises the steps of:

(D) providing at least a second photoluminescent panel, and (E) adhesively securing said at least second panel on said seat.

7. The method of claim 5 wherein said commode additionally comprises a cover pivotally connected to said bowl and a seat pivotally connected to said bowl, said seat being arranged to be selectively disposed on said top surface of said bowl, said cover being arranged to be selectively disposed on said seat when said seat is disposed on said top surface of said bowl, and wherein said method additionally comprises the steps of:

(D) providing at least a second photoluminescent panel, and (E) adhesively securing said at least second panel on said cover.

* * * * *